US005291678A

United States Patent [19]

Murray

[11] Patent Number: 5,291,678

[45] Date of Patent: Mar. 8, 1994

[54] ELECTRIC SIGN WIRING IDENTIFICATION

[76] Inventor: Mickey R. Murray, P.O. Box 120, Magalia, Calif. 95954

[21] Appl. No.: 803,213

[22] Filed: Dec. 6, 1991

[51] Int. Cl.[5] ..... G09F 13/04; H01R 13/64

[52] U.S. Cl. ..... 40/564; 439/488; 40/625

[58] Field of Search ..... 40/625, 628, 630, 316, 40/558, 545; 439/488, 489, 491, 231, 226; 283/81, 114; 24/30.5 S, 563; 411/517, 521, 522

[56] References Cited

U.S. PATENT DOCUMENTS

| | | | |
|---|---|---|---|
| 2,595,487 | 5/1952 | Runge et al. | 439/321 |
| 2,945,204 | 7/1960 | Berger | 339/113 |
| 3,193,415 | 7/1965 | Ray et al. | 40/628 |
| 4,035,632 | 7/1977 | Rayman | 40/545 |
| 4,214,389 | 7/1980 | Fitzgerald et al. | 40/316 |
| 4,475,064 | 10/1984 | Burgess | 439/226 |
| 4,713,016 | 12/1987 | Kato | 439/137 |
| 4,731,809 | 3/1988 | Crane et al. | 379/27 |
| 4,784,614 | 11/1988 | Sadigh-Behzadi | 439/488 |
| 4,820,193 | 4/1989 | Noorily | 439/488 |

OTHER PUBLICATIONS

Round Assorted color coding labels, Miller's Office Products, p. 775. #54-44-800, (1989).

*Primary Examiner*—Kenneth J. Dorner
*Assistant Examiner*—Cassandra Davis

[57] ABSTRACT

A method or system, and the appropriate structural components therefor to allow for readily identifying which particular coded load side conductors of a ballast feed which particular lamp sockets and thus lamps of an advertising sign illuminated by florescent lamps. Coded markers indicative of particular coded load side conductors of the ballast are placed on or adjacent each lamp socket within the open interior of the sign to allow for the quick identification of the sign wiring circuitry without the need to remove lamps or an excessive number of wire raceway covers. In a preferred embodiment, the coded markers are durable, inexpensive to manufacture, readily attachable, readily changeable yet cannot inadvertently be dislodged, and are viewable from generally any angle once a translucent display panel of the sign has been moved to expose the sockets, lamps and adjacent raceways within the interior of the sign.

1 Claim, 10 Drawing Sheets

ELECTRIC SIGN WIRING IDENTIFICATION

BACKGROUND OF THE INVENTION

1. Field of the Invention

This invention relates to the identification of circuit wiring utilized to feed electrical power to the sockets of florescent lamps from the electric ballasts of advertising signs.

2. Description of the Prior Art

Advertising signs utilizing electric lamps, particularly florescent lamps positioned within the interior of the sign to illuminate the translucent sign display panel(s) are widely used today. The florescent sign lamps each have two ends each with exposed electrically conductive terminals so as to be able to receive electricity from a matched set of lamp sockets and thereby be electrically powered and illuminated. One end of each florescent lamp is removably connected to one lamp socket affixed in the interior of the sign, and the other end of each florescent lamp is connected to a second lamp socket at the other end of the sign. The ends of a florescent lamp typically have an interior electrode which is used for starting the arc for causing illumination. The lamps may be positioned vertically or horizontally in the sign. One of the lamp sockets of a matched set of sockets is movable inward and outward, being spring biased toward the outward position so the lamp may be inserted and retained between the two sockets, and then removed when desired. This type of movable lamp socket is commonly referred as a "live end" socket, and the non-movable lamp sockets are commonly referred to a "dead end" sockets. Each florescent lamp is connected to two sockets, and the sockets are connected to the interior of the sign in spaced apart relationship to one another to allow for the removable connection of the elongated lamps. The sockets have lamp receiving recesses for mechanically stabilizing and retaining the lamps, and the recesses are fitted with exposed electrical terminals positioned for receiving the lamp ends and mating with the electrical terminals of the lamps. The rearward or base portion of each lamp socket is specifically shaped and affixed with spring biased holding tabs for affixing the socket removably and stationary to a panel defining a portion of a wire raceway of the sign. Each socket additionally has at least one, and most often two insulated flexible electrical conductors or wires leading and connecting to the exposed electrical terminals on what is considered the front of the sockets. These socket wires are normally about 8 inches in length. The rearward or base ends of the sockets, the location at which the wires exist the sockets, are shaped relative to an aperture in the raceway to allow removable snap-in attachment of the sockets to the raceway. Often the socket receiving apertures are placed in the removable cover of the raceway so the sockets may be removably secured to the raceways with the fronts of the sockets positioned to receive a lamp end on one side of the raceway cover, and the rearward or base end of the sockets with extending wires being positioned on the opposite side of the raceway cover so the socket wires may be fully contained within the raceway when the raceway cover is installed over the open interior of the raceway. The containment of wires in a raceway is primarily for fire and human safety purposes. Normally, a sign will have a raceway with a removable raceway cover at each end of the sign within the interior of the sign adjacent each end of the lamps, and some signs have raceways access covers on the exterior of the sign. With the cover removed from the raceway, the open interior of the raceway is exposed. Within the interior of the raceway are electrical extension wires which connect by way of splicing, usually with wire-nuts, to the short wires extending from the rearward ends of the sockets. The extension wires within the raceway extend within the raceway from their connections to the wires of the lamp sockets through the raceway and connect to the relatively short load side wires of a lamp ballast. Signs with florescent lamps utilize electric ballasts which serve as voltage transformers and power regulators for driving the florescent lamps.

Lamp ballasts are available from many manufacturers in many internal circuitry configurations for driving various lengths of florescent lamps by the ballast. Very often, but not always, a single ballast will include circuitry and accessible load side wires to allow the installer to use that ballast in a number of different arrangements such as to drive two lamps, four lamps, or six lamps, and many common ballasts are rated to operate a range of lamp lengths. A given ballast may power any arrangement of lamps between 16 and 32 total lamp footage for example, depending on how the wiring and lamps are circuited, and this is to reduce the number of ballasts a sign manufacturer must stock in the shop or on a service truck. Some signs use more than one ballast, and normally when two or more ballasts are used in a sign, the sign is logically zoned wherein a ballast mounted high in the sign will drive horizontally positioned lamps high in the sign, and a ballast mounted low in the sign will drive lamps positioned low in the sign. The same logical zoning in a sign holds true with vertical lamps wherein a ballasts placed in the left powers lamps in the left of the sign.

In any case, ballasts have at least two line side conductors, and normally at least four load side conductors, and many common ballasts have anywhere from three to fourteen load side conductors. The load side conductors are normally marked or coded into matched pairs of conductors wherein a matched pair is for connecting to and powering one lamp socket of a matched set of sockets. A second matched pair of load side conductors is for connecting to and powering the second lamp socket of the matched set of lamp sockets. Normally a set or matched pair of load side conductors are each of the same color or coding, and the set or matched pair of conductors for the opposite socket are of the same color or coding as each other, but of a different color than the set of load side wires on the other socket of the set of sockets. For example, two black wires might feed one socket of a set of sockets, and two red wires might feed the second socket of the set of sockets for powering a single florescent lamp.

Color-coding is by far the most common form of coding currently used for load side wires of a ballast, however, coding by numbers has been used in rare instances in the past, and is similar to that commonly used in multi-voltage poly-phase electric motors. The load side wires of ballasts are normally quite short, ranging normally between six inches to six feet in length. The coding, namely color-coding of the load side conductors of the ballast is normally indicative of the relationship of the conductor tap to the windings within the ballast, and the individual ballast manufacturers determine the particular color-coding to be applied to their load side conductors and the schematic diagrams indicating via the color-coding as to how to connect the load side conductors to lamp sockets. Ballasts typically include the schematic wiring diagrams affixed to the front of the ballast showing the often many ways the ballast can be utilized to drive different lengths of lamp arrangements. In these different lamp arrangements, windings of the ballast which have color-coded load side conductors connected thereto, may be connected through the florescent lamps, with the particular connections being in part determined by the total lamp footage desired to be powered. Improper connections to the lamp sockets and thus lamps, and the load side conductors of a ballasts, will result in lamps not illuminating properly, or ballasts or lamps becoming defective (burning out) prematurely.

Ballasts are normally mounted in the interior of the sign, and the raceway or raceways abut the ends or fully enclose the ballasts and extend between the ballast load side wires and the wires on the rearward side of the lamp sockets. The load side wires of the ballasts are very often not of sufficient length to reach the short conductors of the lamp sockets, since signs vary widely in size, and some signs are quite large. When a sign is manufactured, insulated electrical wires are spliced between the relatively short load side wires of the ballasts and the relatively short load side wires of the lamp sockets. The wires of the sockets are normally not of any particular color-coding, and most often are all the same color, and most commonly white today. The load side wires of the ballast are generally always color-coded by the ballast manufacturer, however, different ballast manufacturers use different color-codings, since there is no apparent industry standard for color-coding of a given set of load side conductors representing given winding circuit tap locations within a ballast. When the sign is manufactured by the sign manufacturer, the extension wires ran between the socket wires and the ballast load side wires may be color-coded to match the coloring of the load side wire to which the extension wire connects to, but very often are not, wherein they would all be one color such as black for example. Electrical current will flow regardless of the color of the dielectric insulation over the conductors, and during the manufacturing of a sign, the raceway covers are removed, and thus it is simple to extend the ballast load wires to the socket wires without too much confusion, whether the extension wires match the color-coding of the ballast load wires or not. The completed sign is delivered to the job site, then mounted, and the primary or line side of the ballast is connected to a suitable electrical power source for powering the ballast and thus the lamps. The sign will operate whether the color-coding has been maintained throughout the sign or not, as long as the electrical circuitry is correct.

However, in the future, when the sign needs repair due to a failure of some or all of the lamps to illuminate, which is usually after a few years, the serviceman will have a difficult time determining which ballast load side conductors feed which lamp sockets, and this information is very often crucial to the quick trouble shooting of an inoperative sign. This difficulty for the serviceman will exist whether color-coded wires were used throughout the sign or not, due to most or all of the wiring in the raceways being obscured from view by the opaque nature of the wire raceways and raceway covers, which are manufactured of panels of sheet metal. In order to trace the wiring from the ballast to determine which conductors feed which lamp sockets, it often requires the serviceman to remove all lamps from the sign in order to open the raceways to expose the wiring in the raceways. With the raceways open, the raceway covers will hang on the wiring, and so it is not normally necessary to disconnect all of the wiring connections made by wire-nuts. At this point in the servicing procedure, if the color-coding had been carried throughout the wiring of the sign in accordance with the ballast load side conductor coding and schematic, then the serviceman will have little further difficulty in the tracing of the wiring. However, it requires a significant amount of time to remove all lamps and raceway covers from a sign, particularly if the sign is mounted a significant distance above the ground, and the serviceman is working from a small lift-bucket of a crane or hoist. Furthermore, if the color-coding has not been carried throughout the original sign wiring, even with the lamps and raceway covers removed, the serviceman will spend quite a bit of time tracing the wiring since there typically exists many wires entwine with each other in a raceway.

Additionally, even if the serviceman knows the existing ballasts is burned-out, such as by testing the ballasts prior to removing any lamps and raceway covers, very often a ballast is replaced with a different make and model of ballast, and due to the non-standardized color-coding of the load side wiring from one manufacturer to another, the serviceman may still need to remove all of the lamps in order to remove the raceway covers so he may determine which load side wires of the old ballast connect to which lamp sockets in order to allow him to quickly make the correct electrical circuit connections to the new replacement ballast. Some signs have removable raceway covers placed relative to the lamp sockets which allow removal of the raceway cover without having to remove the lamps, however, it still requires a significant amount of time to remove raceway covers, particularly when they are affixed to the raceway by a large number of screws.

SUMMARY OF THE INVENTION

The invention of this disclosure provides a solution to many of the previously stated problems in the quick identification of which load side wires of a lamp ballast feed which lamp sockets and lamps in a florescent sign. With the present invention, coded markers indicative of the coded load side conductors of the ballast are placed on or adjacent each lamp socket within the open interior of the sign to allow for the quick identification of the sign wiring and circuitry thereof without the need to remove lamps or an excessive number of wire raceway covers. With the present invention, the serviceman may remain stationary in front of an existing ballast and read the schematic on the ballast and glance through the sign to immediately visually determine which set of load side conductors of the ballast feed which lamp sockets and thus lamps of the sign. The invention allows for increased accuracy and speed in trouble shooting a sign lighted by florescent lamps.

In a preferred form, the coded markers are durable, inexpensive, readily attachable, readily changeable yet cannot inadvertently be dislodged, and are viewable from generally any angle once the translucent display panel of the sign has been repositioned or removed to expose the lamps and adjacent raceways in the interior of the sign.

Objects of the invention include providing a method or system, and the appropriate necessary structural components therefor to allow for readily identifying which coded load side ballast conductors feed which lamp sockets of a sign without having to remove lamps, sockets, or an excessive number of raceway covers.

A further object of the invention is to provide the above in a manner which allows for easily changing out a ballast having one coding for the load side wires to an equivalent ballast having a different coding for the load side wires.

A still further object of the invention is to provide the above wherein an existing sign can easily be modified with the invention.

An even further object of the invention is to provide the above in a manner which is inexpensive to utilize on new and existing signs.

A still further object of the invention is to provide the above by way of method and structure which is compatible with existing sign hardware and wiring procedures currently used in the industry.

These and further objects of the invention will be better understood with continued reading in conjunction with an examination with the accompanying drawings.

BEST MODE FOR CARRYING OUT THE INVENTION

Figure 1:
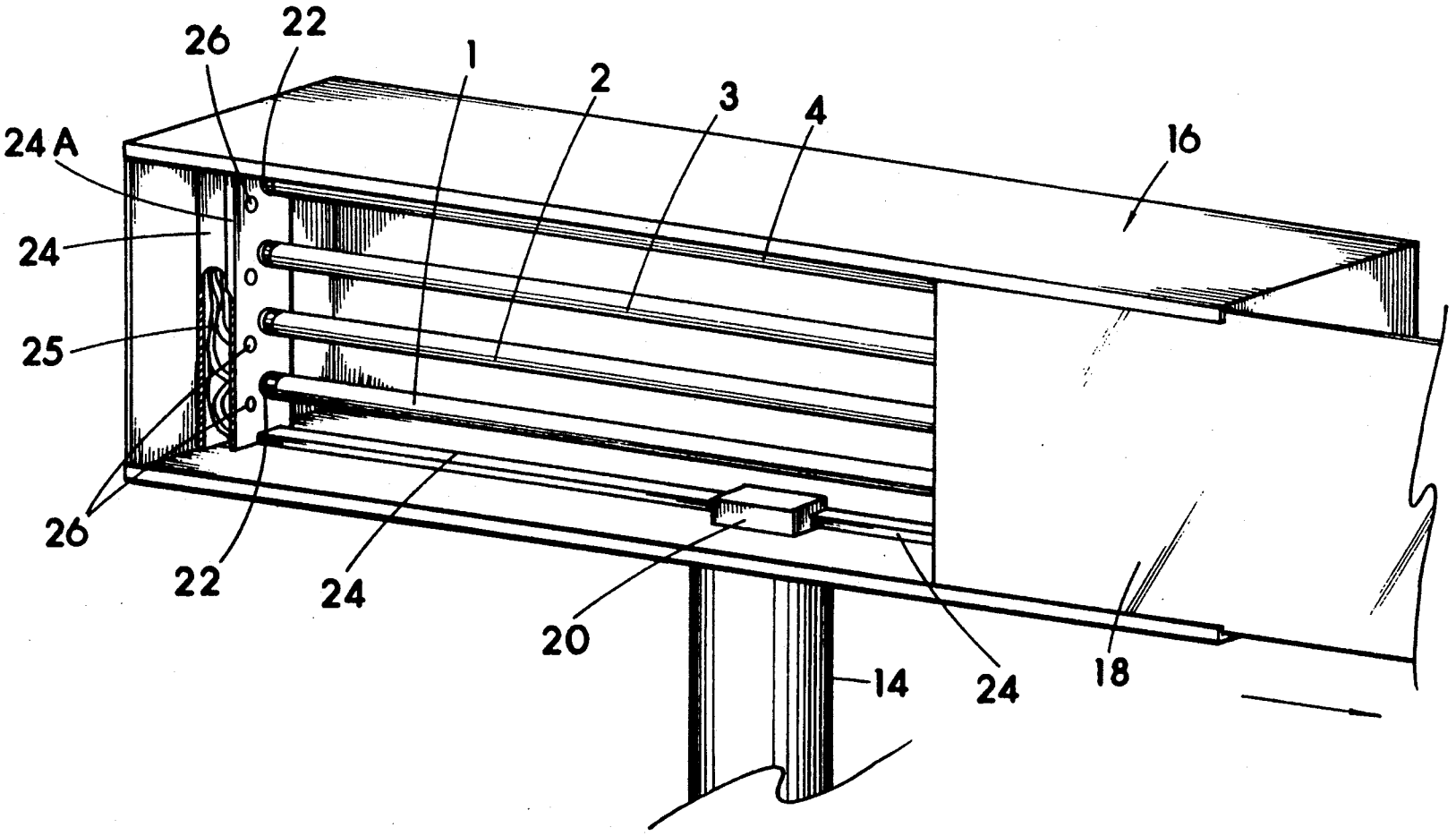
FIG. 1 shows a sign with the front translucent display panel slid to one side to allow access to the interior of the sign and the ballast, lamps, sockets, and raceways and raceway covers of the sign. A cut-way is used in one portion of the raceway to illustrate the normally hidden wiring therein, and a small circular stick-on or painted-on marker or codifier is shown affixed on the exterior surface of the raceway adjacent each lamp end and socket.
Figure 11:
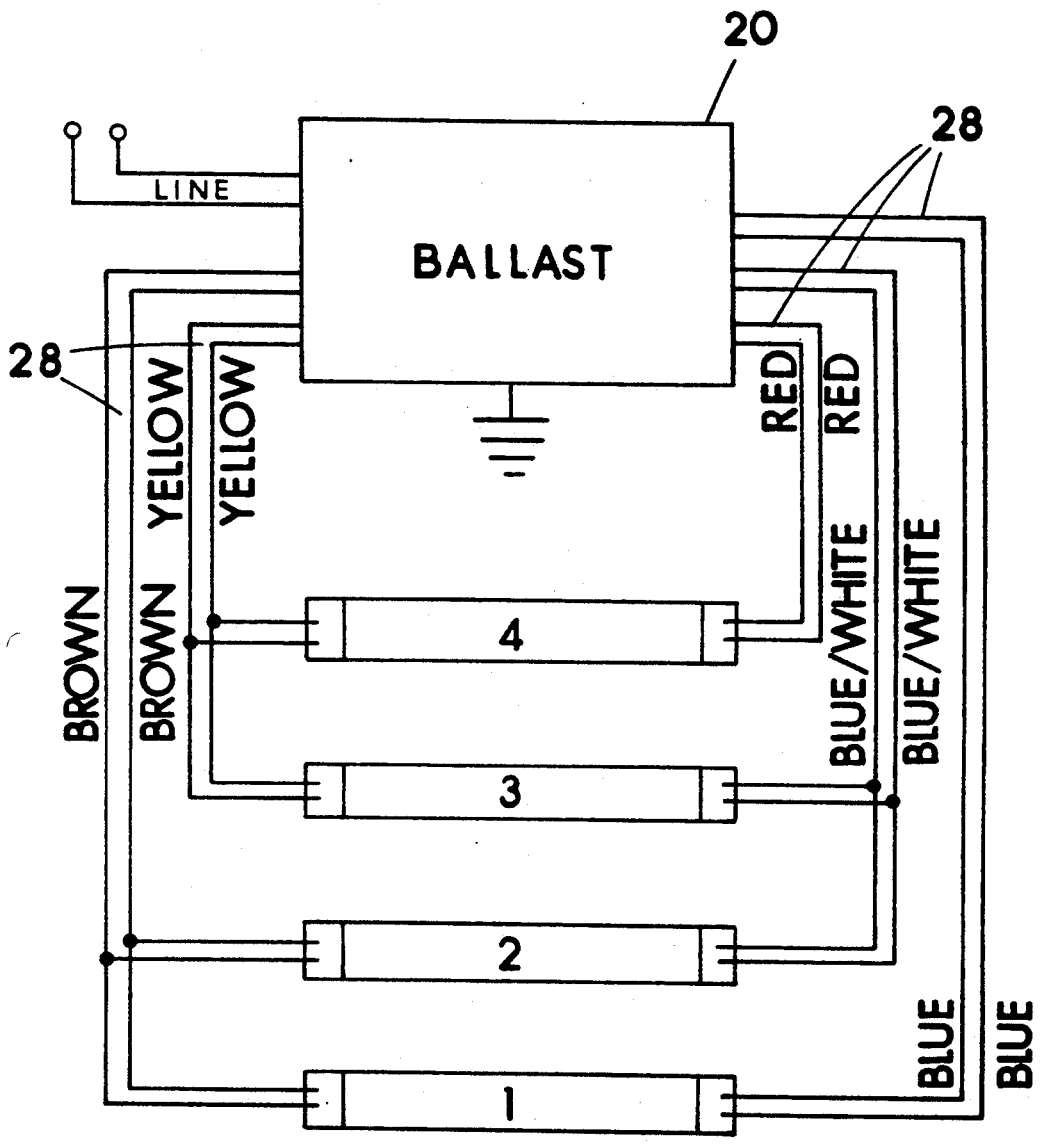
FIG. 11 illustrates a typical wiring diagram or schematic for connecting a ballast to four lamps of a sign.

Referring now to the drawings in general and particularly to FIG. 1 wherein a typical sign 16 is shown modified in accordance with the present invention. Sign 16 is illustrated with the front translucent display panel 18 slid to one side to allow for access to the ballast 20, lamps 1, 2, 3, and 4, sockets 22, and raceways 24 and raceway cover 24A within the open interior of sign 16. Sign 16 is free standing, shown attached to a support post 14, but could be mounted to the front of a building as is commonly done. Normally a free standing sign will have a translucent display panel 18 on each side of the sign 16, either one of which may be removed or repositioned as in FIG. 1 to access the open interior of the sign 16. In FIG. 1, a cut-way is used in one portion of the raceway 24 to illustrate the otherwise hidden electrical wiring of which some may be load side conductors 28 and some may be extension wires 25, and a small circular stick-on or painted-on marker 26 is shown affixed to the exterior of raceway 24 and specifically to raceway cover 24A adjacent each of the lamps 1, 2, 3, and 4, and sockets 22. The ends of the lamps 1, 2, 3 and 4 obscure from view all but the edges of the fronts of the sockets 22. The opaque raceways 24 are shown extending horizontally from each end of ballast 20 and then turning vertically and extending upward. The markers 26 may be colored painted-on markers, or may be adhesively affixed disks of paper, plastics or metal markers affixed to a panel of raceway 24 such as raceway cover 24A. The markers 26 could be affixed anywhere, as long as there could be no confusion as to which socket 22 the markers were applicable to, but since lamps are changed out frequently, the ends of the lamps would not be an ideal place to affixed the markers 26. The interior opposite right hand end of the sign 16 which is covered from view by sign display panel 18 would appear substantially the same as the shown left hand end of sign 16, and would also have markers 26 affixed adjacent the sockets 22 and lamp ends. Ballast 20 would have a factory applied schematic diagram such as that in FIG. 11 showing color or otherwise coded load side wires 28 and how they would need to be properly connected to feed the four lamps 1, 2, 3, and 4 of sign 16. Each of the markers 26 in accordance with the invention would be colored or numbered, and this being determined by the coding system used on the load side conductors 28 of the ballast 20. Assuming for the moment that the load side conductors 28 of ballast 20 are color coded since this is by far the most common coding today, markers 26 placed adjacent a socket 22 and lamp end as shown in the drawing would be colored to match the particular color of the set of load side conductors 28 feeding the socket 22 at that lamp end. For example, if a set of yellow load side conductors 28 of ballast 20 are responsible for feeding the left hand socket 22 of lamp 4, then the marker 26 at that socket 22 would be yellow in color, regardless as to whether un-coded extension wires were used between the short yellow load side conductors 28 of ballast 20 and the short wires 47 of the socket 22. The opposite or right hand end of lamp 4 would normally be connected to a set of colored load side wires 28 of ballast 20 which were other than yellow, for example red, and this being in accordance with the ballast manufacturers schematic attached to the top of the ballast 20. Accordingly, the marker 26 at the right hand end of lamp 4 would be red in color. A brief examination of FIG. 11 may assist in better understanding the normal color coding of the-load side wiring 28 of a ballast, and how this coding is applicable to connecting lamps and shown in FIG. 12. Load side conductors 28 of ballast 20 which are color coded by way of a base color such as blue with a tracer such as white for example, will require markers 26 to be compatibly colored with a blue base color having a white line(s) to indicate the socket 22 adjacent the marker 26 is fed by ballast 20 load conductors 28 of a blue with white tracer color coding. Ballast 20 if having load side conductors 28 coded by numbers rather than by color, would require markers 26 to have visible numbers applied by pen or pencil, hot stamping or printing in order to be utilized within the same general procedure as the colored markers 26, and these same principles should be followed if letters or other graphic symbols were used instead of color or numbers on the load side conductors 28 of ballast 20. If symbols, numbers or letters were used as the coding system, and this might even be applicable to a color coding system, markers 26 might be provided in a manner wherein the exposed surface could be written upon to display a letter, symbol, number, or maybe a word or abbreviated word representing for example black, red, yellow or whatever is necessary. In this write-on surface embodiment, the surface might even desirably and feasibly be erasable to allow intentional changes or updates such as when a new replacement ballast was installed in the sign. White vinyl plastic stick-on labels might work well as a write on surface which the writing could be smudged off and updated or modified.

FIG. 1 shows sign 16 in a condition for servicing wherein the display panel 18 is slid to one side for servicing the center and the left hand end of the sign, and the panel 18 may be completely removed or slid to the left hand end of the sign 16 to service the now covered right side or end of the sign 16 if necessary. With markers 26 applied as described above, a serviceman may read the schematic diagram on ballast 20 and view the markers 26 and readily determine which ballast load side conductors 28 feed which lamp sockets and which lamps, and this will allow him to readily replace the ballast if need be without having to remove anymore raceway covers other than what is necessary to remove the old ballast. If the replacement ballast had different codings such as color or numbers, the serviceman would now have sufficient information to correlate matched load side wire 28 sets to a given matched pair of sockets 22 and thus lamps, and could quickly and properly wire-in the new ballast. The serviceman could also more easily, quickly, and safely perform other trouble shooting procedures such as testing socket 22 and wire continuity due to markers 26.

The markers 26 in their various possible forms will function well within the governing principles of the present invention as described above, however these markers 26 may not be the perfect marker structure for reasons such as possibly not being as readily removable as may be desired dependant upon the specific structure thereof, or viewable from all angles that the serviceman may be positioned in while servicing the sign 16. The lamps might block the view of the serviceman from easily seeing the markers 26 dependant upon which translucent display panel 18 he opened to service the sign 16 Additionally, it is conceivable the adhesive which might be used to affix markers 26 could give way after an extended period of time resulting in the serviceman finding the bottom interior of the sign cluttered with markers 26 which had fallen off, when he opened the sign to service it. Signs are normally exposed to wide swings in temperatures throughout the year, and these wide temperature swings may cause the decay of adhesives, and therefor mechanical fasteners to fasten markers in accordance with the present invention might be more desirable.

When the serviceman installs a replacement ballast as described above, he should modify or update markers 26 or apply new markers 26 which are coded to match the particular coding of the load side conductors 28 of the new ballast if they differed from the color codings of the old ballast. The up-dating or replacement of old markers 26 with new markers 26 ideally should be quick, simple and inexpensive, and a marker having a surface which could be written on and then erased might fit these requirements as might other markers which will now be described.

All markers henceforth described should use a codifier or codifying arrangement in accordance with the governing principles of the present invention as previously described relative to markers 26, sockets 22, and the load side conductors 28 of ballast 20 of sign 16.

Figure 2:
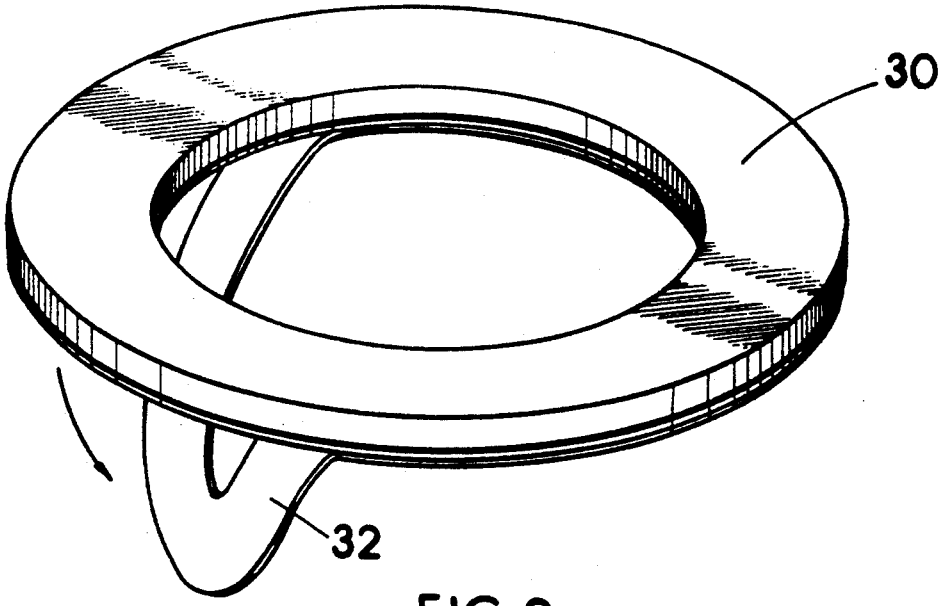
FIG. 2 illustrates another type of marker which may be utilize within the scope of the invention.
Figure 3:
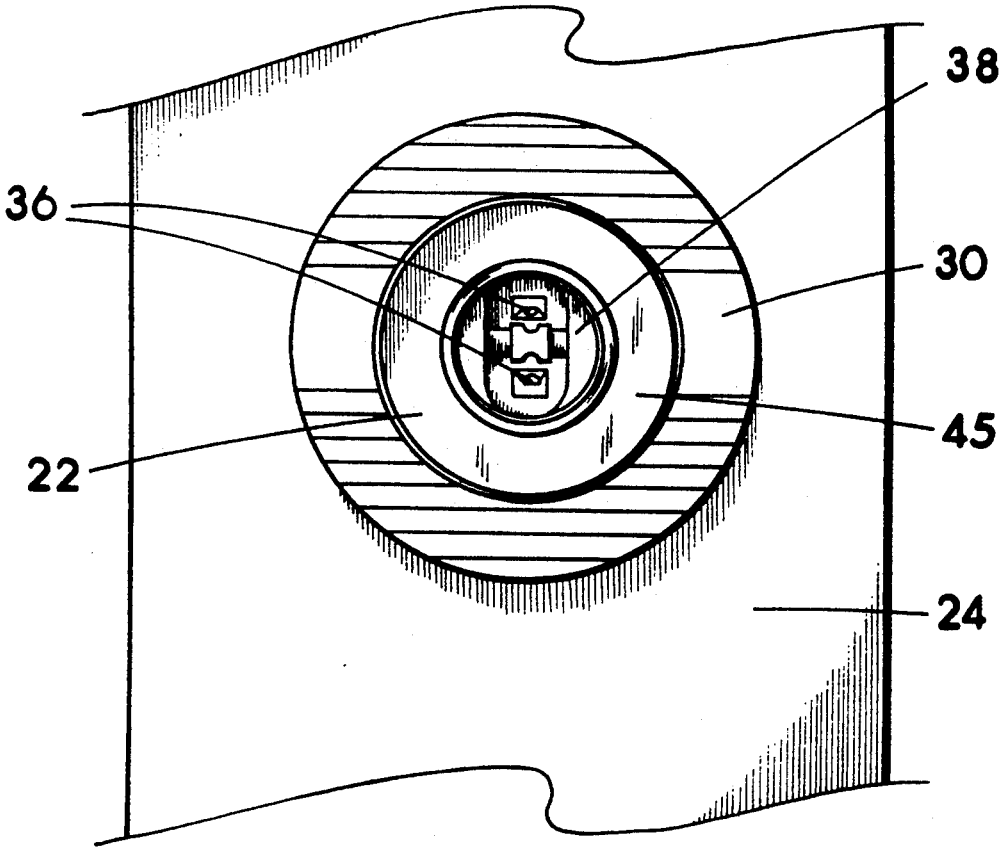
FIG. 3 illustrates a marker of the type shown in FIG. 2 placed around the exposed widened front of a common lamp socket affixed in a panel of a raceway.

The FIG. 2 drawing shows another form of possibly suitable marker designated by 30. Marker 30 has a central aperture which fits loosely around the widened front 45 of florescent lamp socket 22, and is adhesively affixed to one of the panels defining raceway 24 as shown in FIG. 3. The FIG. 2 marker 30 is illustrated as to represent a single solid color, and the FIG. 3 marker 30 is illustrated as a base color with a tracer shown by the lines across the wide front surface of the marker. The aperture of the marker 30 is larger than the major diameter of the front of the socket 22, and is affixed via adhesives independent of the mounting arrangement used for the socket 22. The marker 30 may be considered improved from the marker 26 in such terms that the marker 30 is viewable from generally every angle the serviceman may be in while working in the interior of the sign 6, and the marker 30 could be retained adjacent its socket even if the adhesive gave way, since the marker 30 would then be essentially hanging on the adjacent lamp end. Marker 30 might be best manufactured with a peel-off backing 32 as shown in FIG. 2 wherein with backing 32 removed, a pre-applied tacky adhesive would be exposed. Also shown in FIG. 3 are the electrical terminals 36 within the recess 38 within the front 45 of socket 22 for receiving a lamp end. Although marker 30 is considered to have some advantages over marker 26, it might still be improved upon.

Figure 4:
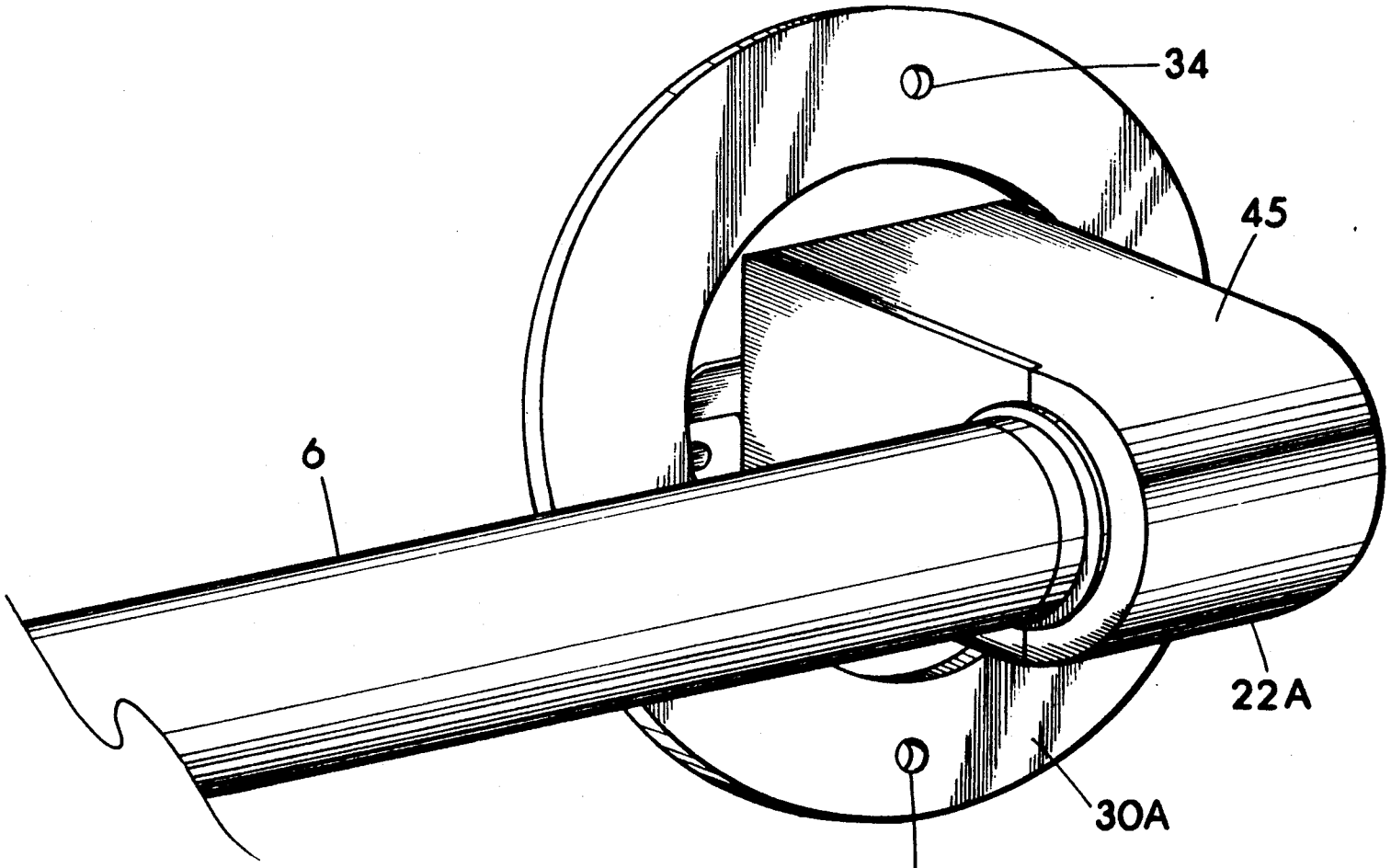
FIG. 4 illustrates a slightly different marker from the marker of FIG. 2 which may also be utilized within the scope of the invention. The marker is shown around a type of lamp socket which is relatively common, but different than the lamp socket of FIG. 3.

FIG. 4 illustrates a slightly different marker 30A from markers 26 and 30, in that the marker 30A of FIG. 4 has apertures 34 for attaching the marker 30A by bolts or screws to a panel of raceway 24. Screws will work, but may be slower to apply than adhesive as is used with marker 30, and the screws should not have sharp points which could cut into the wiring within the raceway 24. The screw attachable marker 30A of FIG. 4 is shown around a different style of lamp socket from that shown in FIG. 3, and the socket is designated 22A. One end of a florescent lamp 6 is shown connected to socket 22A in FIG. 4. Marker 30A has a large central aperture to allow the marker to be affixed to a panel of a raceway 24 and to encircle a socket 22 or 22A.

Figure 5A:
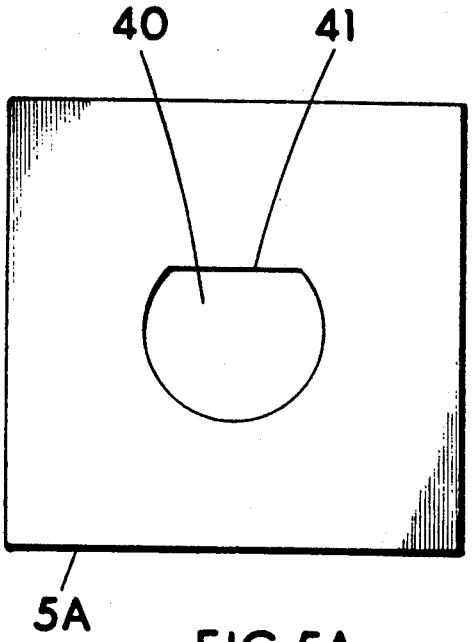
FIGS. 5A through 5D illustrate additional various types of markers which may be utilized within the scope of the invention.

Referring now to markers 5A, 5B, 5C, and 5D of the like designated drawing figures. FIG. 5A and 5B illustrate markers 5A and 5B respectively, which could be mechanically retained by the existing mechanical arrangement commonly used on most sockets 22 and 22A today. Markers 5A and 5B each have central apertures 40 sized for fitting somewhat loosely over the narrowed bases 44 of sockets 22 and 22A. Marker 5A is shown with an indexing flat 41 in the otherwise circular central aperture 40, and this shape of aperture is identical to the most commonly used aperture 48 shape in a panel of a raceway 24 in which a socket 22 or 22A is snapped into for attachment. The indexing flat 41 of marker 5A would be optional, and would work in conjunction with the existing indexing flats common on the bases 44 of the sockets 22 and 22A to prevent the marker 5A from spinning around the base 44 of the sockets 22 or 22A, and possibly tipping one corner of the marker into the path of a display panel 18 being slid into the closed position wherein the raceway 24 or cover 24A was quite narrow such as only about two inches wide. The rearward ends of most sockets 22 and 22A have indexing flats to help prevent the sockets from spinning within the socket receiving apertures 48 in the panels of the raceway 24 of the sign. The apertures 48 in the raceway retain the sockets by way of snap-in attachment. Markers 5A or 5B could be slid over the rearward end or base 44 and the short wires of such sockets 22 or 22A, and providing the markers 5A and 5B were sufficiently thin in nature, around fifteen thousandths of an inch for example, the socket 22 or 22A could be snapped into a socket receiving aperture 48 and the marker would be retained by the widened front 45 of the socket 22 or 22A. This arrangement using markers 5A or 5B might however require the removal of both the lamp and the socket 22 or 22A from the panel of the raceway 24, and then the disconnecting of wire nuts from the wires 47 of the socket in order to replace the marker 5A or 5B, and therefor this style of marker might still be improved upon.

Figure 5C:
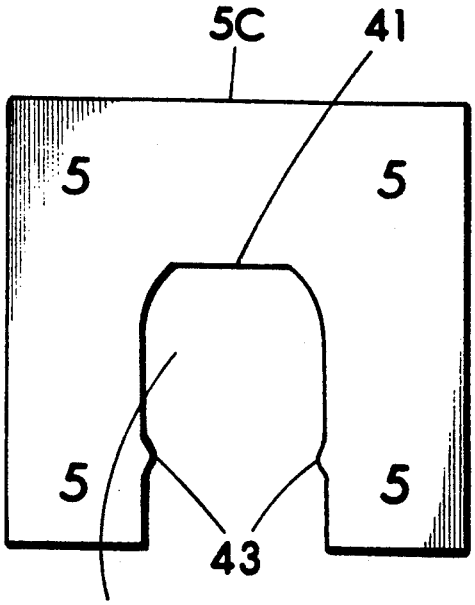
Figure 5B:
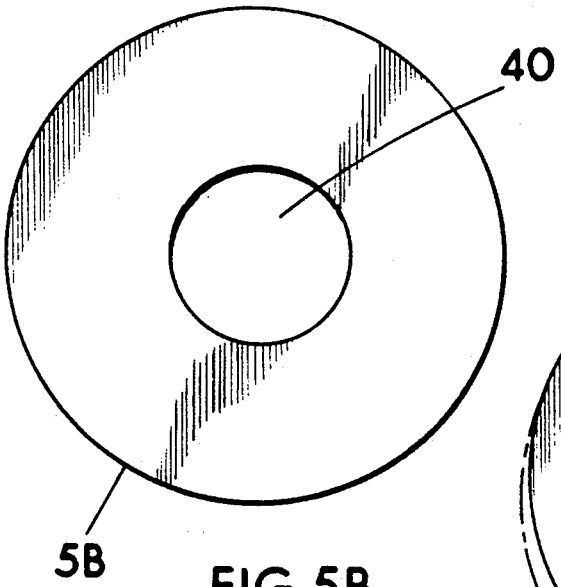
Figure 5D:
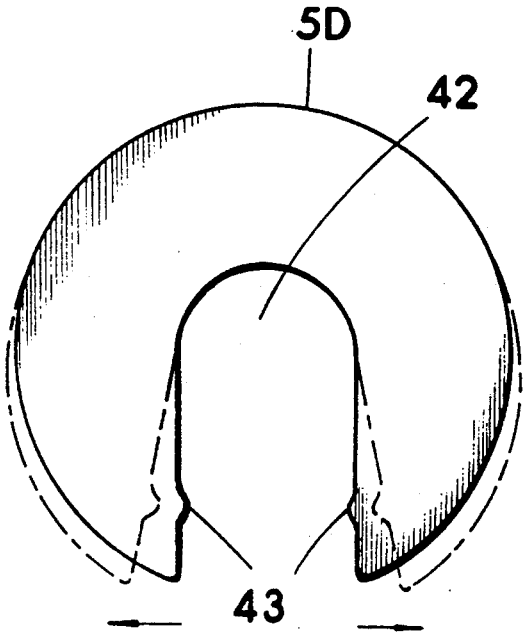

FIG. 5C and 5D illustrate markers 5C and 5D respectively, which provide many of the desireable attributes in a marker in accordance with the principles of the present invention. Both markers 5C and 5D are thin edgewise, and each have somewhat of a horse-shoe-shaped wide flat front and rear surface defined in part by a U-shaped notch 42. Notches 42 include at least one and probably more effectively, two inwardly extending members or tabs 43 extending inward into the open U-shaped space of notch 42 toward each other. Markers 5C and 5D are structured to also be placed over the narrowed base 44 of sockets 22 or 22A and to be placed in use between the front surface of a panel of a raceway 24 and the rearward surface 45A of the widened front 45 of a lamp socket much the same as markers 5A and 5B. However, markers 5C and 5D are structured so they may be inserted between the rear surface 45A of the front 45 of a socket 22 or 22A and the raceway panel 24 with the socket installed in the panel of the raceway 24 and the wires fully connected, and this being primarily because of the U-shaped notches 42. With this structuring, markers 5C and 5D may be install or removed while the sockets 22 or 22A are initially being installed in the raceway 24, or may be installed or removed with the sockets 22 or 22A already installed in the raceway aperture 48. Additionally, the florescent lamps might be engaged with the sockets when the markers 5C and 5D were applied or removed. Marker 5C is also shown with the optional indexing flat 41, and additionally is illustrated with a number 5 in each of the four corners of the front thereof to illustrate how the marker might appear if numbers or other graphic symbols were the coding system used instead of color.

Shown in both markers 5C and 5D are the tabs 43 toward the open end of the U-shaped notch 42 toward the edge of the markers and aligned straight across from one another. There is provided space between the tabs 43 and the closed ends of the U-shaped notches 42 in both markers 5C and 5D for the narrowed bases 44 of sockets 22 or 22A to reside in with the tabs 43 positioned forward or slightly beyond the bases 44 of the sockets to serve as locking members to prevent the markers 5C and 5D from falling off of the sockets 22 or 22A, see drawing FIGS. 6 through 10. Markers 5C and 5D are manufactured of generally rigid material so as to be sufficiently thin and adequately rigid to stand erect so as not to flop over onto the end of the lamp. The material of which the markers 5C and 5D are manufactured also needs to have a small degree of flexibility and resiliency so as to allow the markers to bend a little and to widened slightly in the areas thereof to allow tabs 43 to glide over the major diameter of the exterior surface of a base 44 and then for the marker to return to a relaxed position where the tabs 43 move back toward one another inward of the major diameter of the base 44 of the socket wherein the tabs 43 serve as locking tabs, see FIG. 5D. The approximate stiffness of a card of a deck of playing cards is about right for markers 5C and 5D. Materials such as paper, plastics, or sheet metals are materials which will work if properly selected for the making of markers 5C and 5D. Attributes which should be considered when selecting materials for markers 5A, 5B, 5C and 5D, or any other form of marker which comes in close proximity or contact with a socket 22 or 22A, are stiffness, ability to be colored or marked upon, and heat resistance of the base material and any printing or coloring in or on the marker. The need for a degree resistance to heat is because sockets 22 and 22A can get somewhat hot during normal use, and sometimes the terminals 36 become corroded leading to high electrical resistance and the sockets reaching a very high temperature and burning out.

Figure 6:
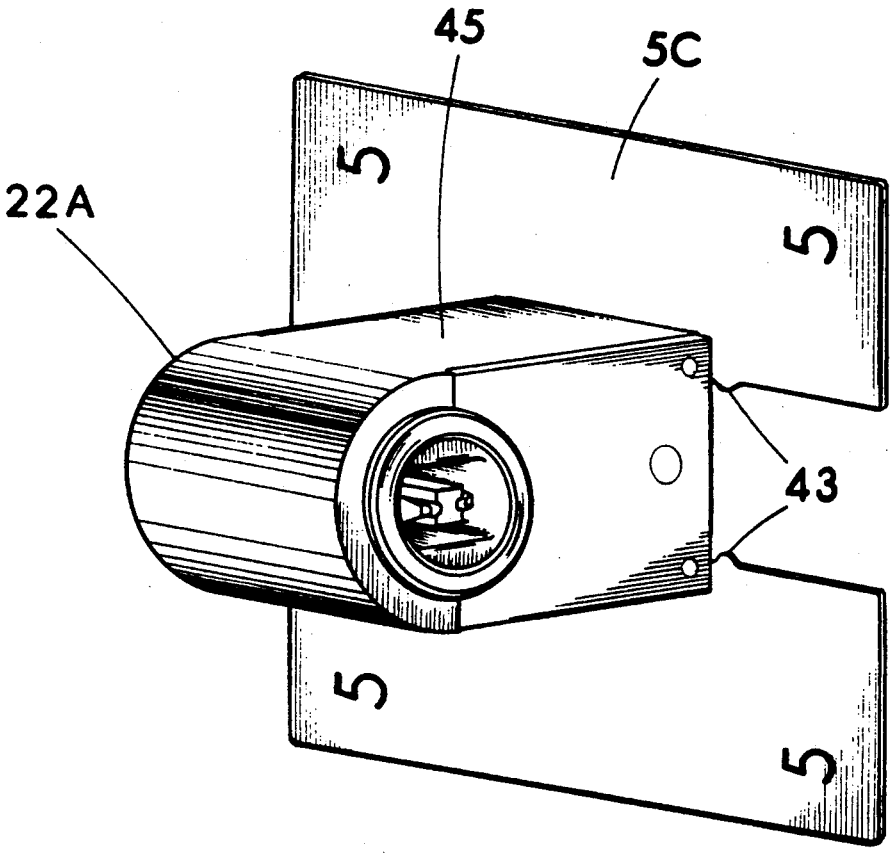
FIG. 6 illustrates the marker of FIG. 5C in use on a lamp socket.

FIG. 6 illustrates the marker 5C placed around the base of a socket 22A, the base is not viewable from the shown angle, and the front of the marker 5C abutted against the widened front 45 of a socket 22A.

Figure 7:
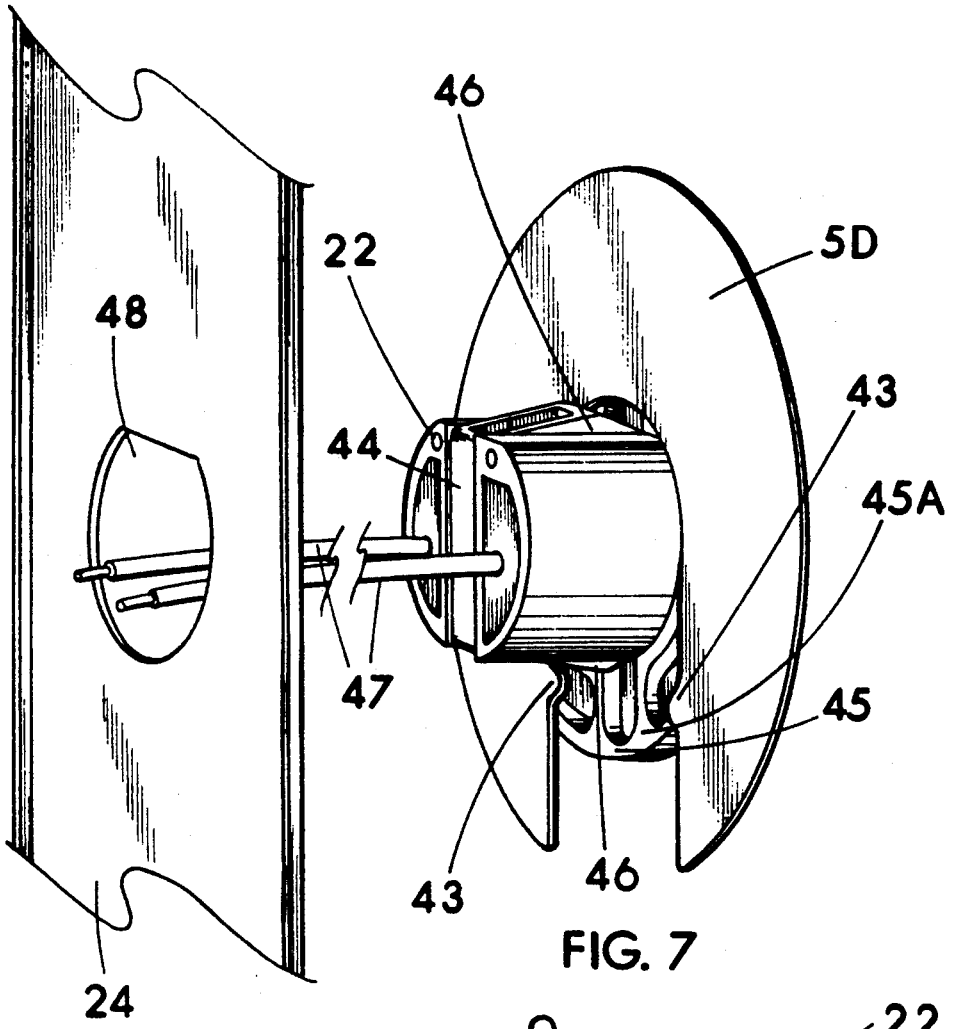
FIG. 7 illustrates the marker of FIG. 5D placed over the narrowed base and abutted against the rearward side of the widened front of a lamp socket, and the socket in the process of being installed in an apertured panel of a raceway.

FIG. 7 illustrates the marker 5D placed over the base 44 of a socket 22. The socket 22 is not yet installed into the aperture 48 of the raceway 24. The marker 5D is shown abutted against the rearward surface 45A of the widened front 45 of the socket 22. This position placed the marker 5D between surface 45A of front 45 and the terminal ends of the spring biased tabs 46. Tabs 46 hold the socket 22 in aperture 48 of a raceway 24 and are better shown in FIG. 9. Also shown in FIG. 7 are two wires 47 extending from the base 44 of the socket 22.

Figure 8:
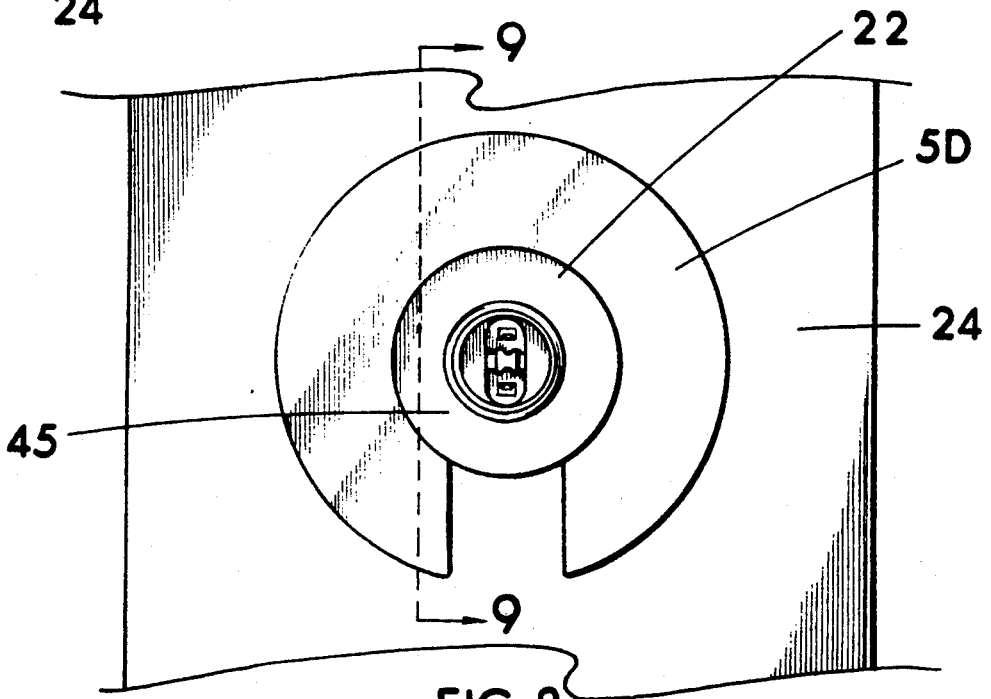
FIG. 8 illustrates the marker of FIG. 5D placed over the narrowed base and abutted against the rearward side of the widened front of a lamp socket with the lamp socket affixed to a panel of a raceway to sandwich the marker between the front surface of the raceway panel and the rear surface of the widened front of the socket.

FIG. 8 illustrates the marker 5D placed over the base of a socket 22 with the socket installed in a panel of a raceway 24.

Figure 9:
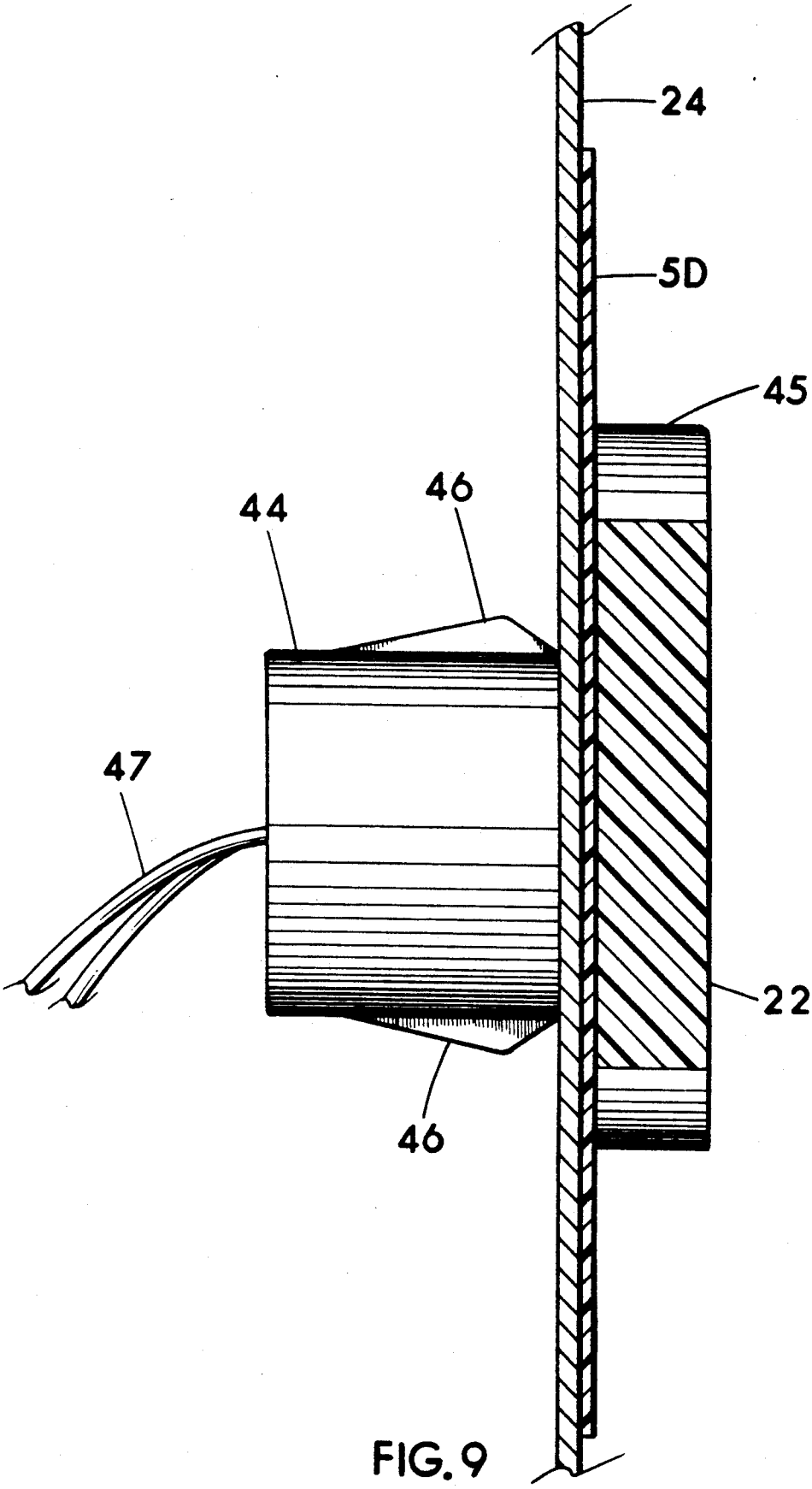
FIG. 9 is a cross-sectional view taken at line 9—9 of FIG. 8.

FIG. 9 is a cross-sectional view taken at line 9—9 of FIG. 8, more clearly showing the relationship of marker 5D relative to the panel of a raceway 24, the front 45, and base 44 and spring tabs 46 of the socket 22.

Figure 10:
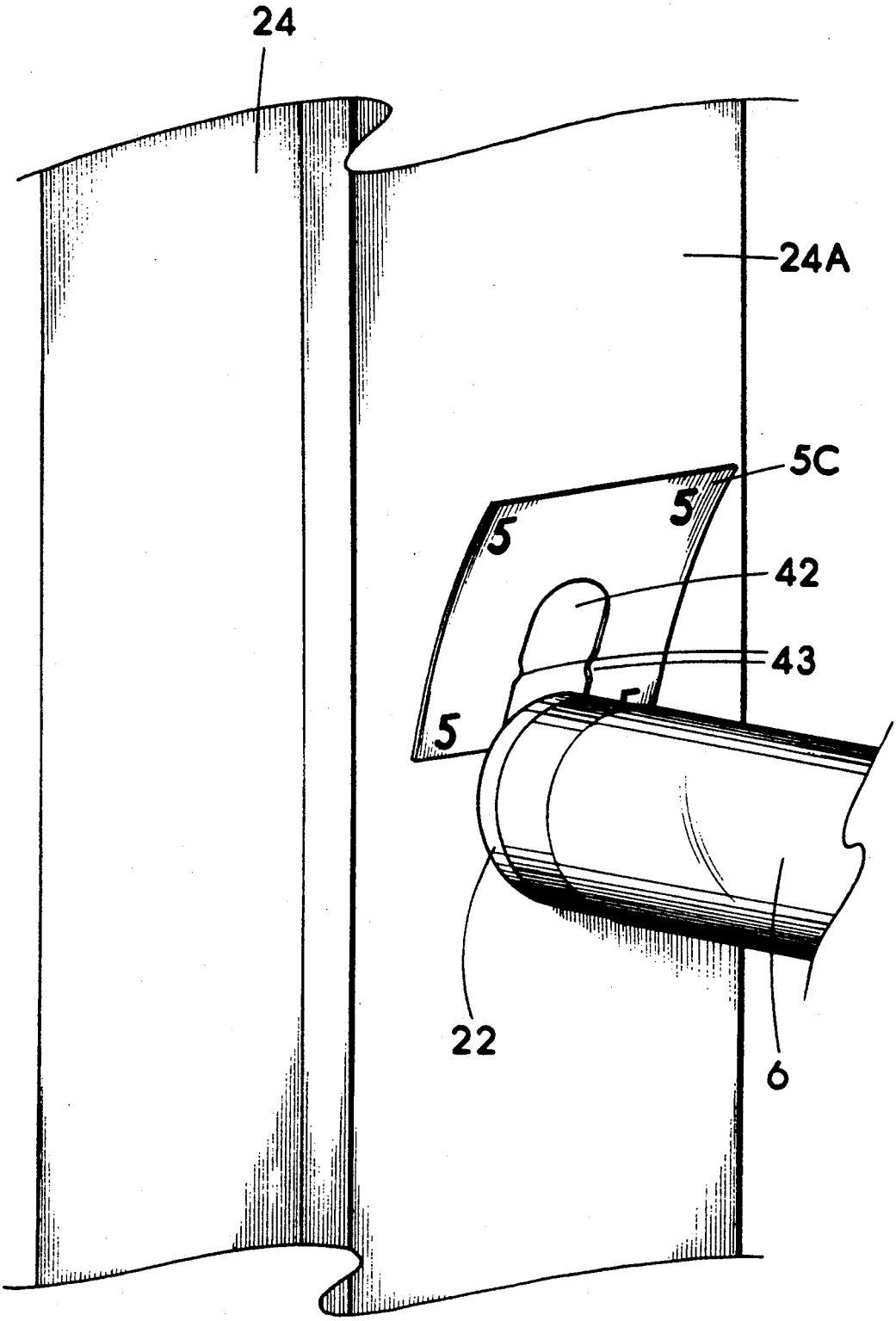
FIG. 10 illustrates the marker of FIG. 5C either in the process of being installed or removed from a socket.

FIG. 10 illustrates the marker of FIG. 5C in a position which might be being installed or in the process of being removed by way of sliding inward or outward from between a socket 22 and the raceway cover 24A of a raceway 24. To install a marker such as marker 5C or 5D even with a lamp 6 in place in the socket 22 as is shown, one only needs to align the opening of U-shaped notch 42 with the approximate center of the socket base 44 of the socket and press the marker toward the center taking care to maintain the leading edge of the marker pressed tightly against the panel of the raceway 24, and the marker if properly stiff and thin in nature will slip, with a little force applied between the panel of the raceway and the rearward surface 45A of the front 45 of the socket 22 or 22A. Sometimes one may which to pull the end of the lamp slightly away from the socket in order to make it easier to slip the marker in place. Normally, a socket 22 or 22A will have sufficient space (slop), normally between twenty and fifty thousandths of an inch between the panel of the raceway 24 and the rearward surface 45A of the front 45 of the socket, the space either existing or being easily created with a little force to allow the slipping in of a marker 5C or 5D as previously described. The space between the rearward surface 45A of the front 45 of a socket 22 or 22A and a panel of a raceway 24 will vary dependant on the particular socket which are made by different manufacturers, and the thickness of the sheet metal with which the panel of the raceway 24 is made, and in FIG. 9 the marker 5D is shown residing in the space. I have found that a marker such as 5A, 5B, 5C or 5D made about fifteen thousandths of an inch in thickness will normally work. See FIG. 9 to better understand the required thin nature of markers 5A, 5B, 5C and 5D. The markers 5C or 5D may be removed by pulling, but due to tabs 43 of the markers being normally inward of the major diameter of the base 44 of the socket, the marker should never fall off such as with the sign 16 vibrating in the wind for example.

FIG. 11 illustrates a typical wiring diagram or schematic for connecting a ballast 20 to four lamps 1, 2, 3, and 4 to color-coded load side wires 28. The line side of the ballast 20 is also shown.

Figure 12:
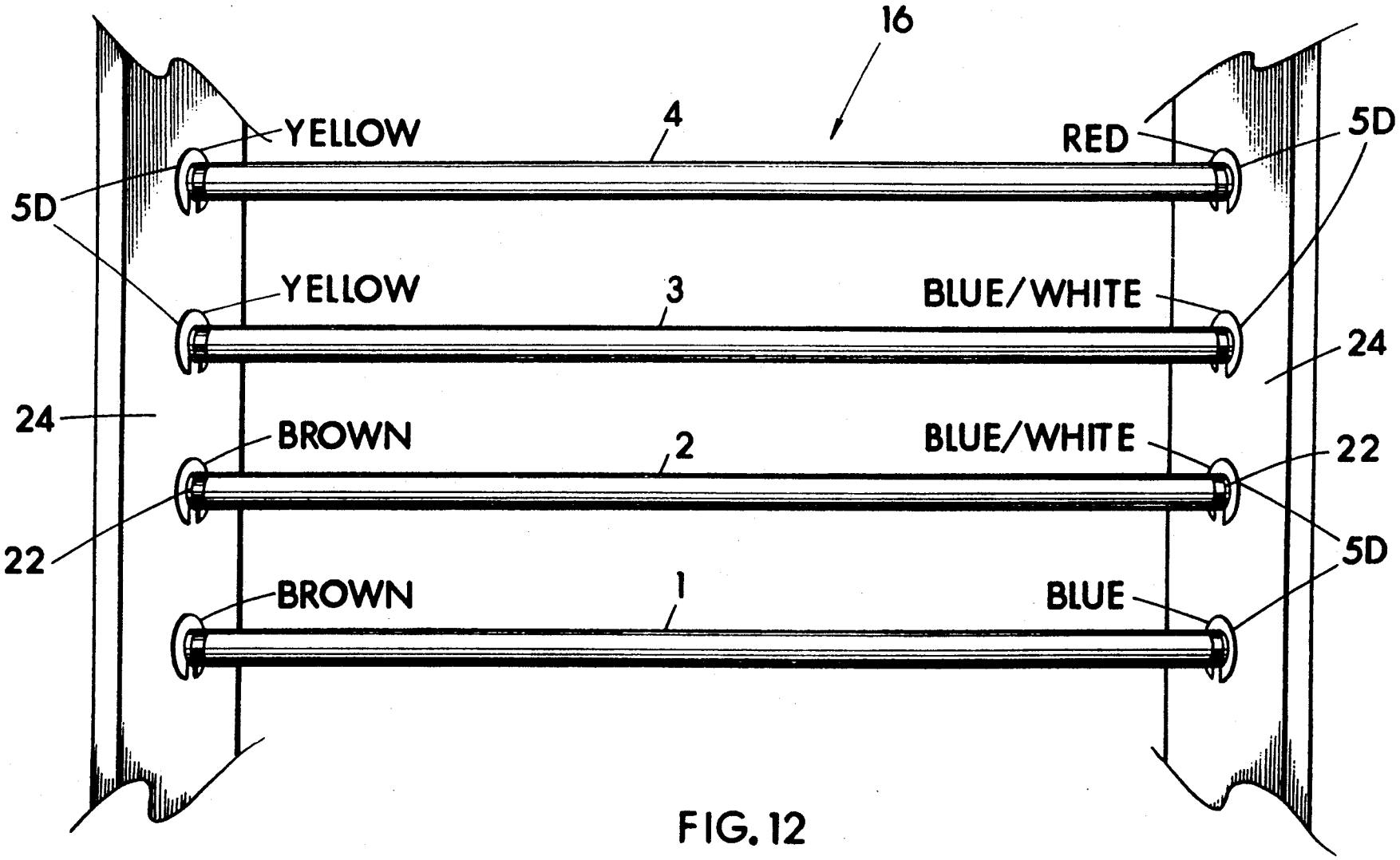
FIG. 12 shows a plurality of the markers of FIG. 5D on a sign shown illustratively with four lamps, and wired in accordance with the schematic of FIG. 11.

FIG. 12 shows a plurality of color-coded markers 5D on a sign 16 shown illustratively, and wired in accordance with the schematic of FIG. 11. It should be noted that often two adjacent lamps ends and their sockets are fed essentially by the same color of load side wires 28 such as is the case with the left hand ends of lamps 3 and 4 in FIG. 12. In this situation, I have considered structuring a marker which might attach to the left end of lamp 4 and also indicate, possibly by way of a pointing arrow, that the marker which is yellow in this example, also is the code color of the adjacent left end of lamp 3, and this might cut down on the numbers of markers needed.

Marker 5A, 5B, 5C and 5D may be manufactured in a number of ways such as by die cutting or stamping from sheet material of the appropriate thickness and color, or the coloring or coding might be applied as a secondary manufacturing step. Hot stamping or ink printing might be used to apply graphic symbols or colors. Plastic injection molding might be used to make the markers, and in any case, these markers should be quite inexpensive to manufacture.

I have also considered the possibility of lamp sockets 22 or 22A being manufactured in a variety of colors, and this would be feasible within the scope of the present invention, although it may be slightly more expensive for the end user.

From the foregoing, it should be clear to those skilled in the art that the present invention using individual coded markers indicative of the coded load side conductors of the ballast placed adjacent the lamp sockets or in or on the lamp socket will allow for the quick identification of the sign wiring and circuitry thereof without the need to remove lamps or an excessive number of wire raceway covers. With the present invention, the serviceman may remain stationary in front of an existing ballast and read the schematic on the ballast and glance through the sign to immediately determine which particular set of load side conductors of the ballast feed which particular lamp sockets and thus lamps of the sign. The invention allows for increased accuracy and speed in trouble shooting a sign lighted by florescent lamps or lamps similar thereto, and may actually increase safety for the serviceman.

Although I have very specifically described the present invention, it should be understood that the specific details are given for example to those skilled in the art. Many minor changes in the specific details and structures described may obviously be made without departing from the true scope of the invention, and therefore it should be understood that the actual scope of the invention is not to be overly limited by the specification and drawings given for example, but is to be determined by the spirit and intended scope of the appended claims.

What I claim as my invention is:

1. In combination, an advertising sign having opaque wire raceways containing wiring connecting color-coded load side wires of a ballast within said sign to lamp sockets supported by said raceways, said lamp sockets having a single base each having a front surface for supporting florescent lamps within said sign, therebeing a plurality of generally flat panel color-coded markers each having a central opening, said color-coded markers being affixed one said color-coded marker adjacent the front of each of said lamp sockets, therebeing a single base of each of said lamp sockets inserted within said central opening of the adjacent said color-coded markers, said color-coded markers each being of a color equivalent to a particular color of said color-coded load side wires such that a particular color coded marker adjacent a particular one of said lamp sockets will allow visual detection of which said color-coded load side wires of said ballast feeds said particular one of said lamp sockets of said sign.

* * * * *